US005451987A

United States Patent [19]

Perrin

[11] Patent Number: 5,451,987

[45] Date of Patent: Sep. 19, 1995

[54] INK CIRCUIT PARTICULARLY INTENDED TO PRESSURIZE A PIGMENT INK FOR AN INK JET PRINTER

[75] Inventor: Max Perrin, Granges lès Valence, France

[73] Assignee: Imaje, Bourg les Valence, France

[21] Appl. No.: 687,882

[22] PCT Filed: Sep. 28, 1990

[86] PCT No.: PCT/FR90/00696

§ 371 Date: Jul. 24, 1991

§ 102(e) Date: Jul. 24, 1991

[87] PCT Pub. No.: WO91/04862

PCT Pub. Date: Apr. 18, 1991

[30] Foreign Application Priority Data

Oct. 2, 1989 [FR] France ..... 89 13060

[51] Int. Cl.[6] ..... B41J 2/00

[52] U.S. Cl. ..... 347/6; 347/85

[58] Field of Search ..... 347/6, 7, 84, 85, 89

[56] References Cited

U.S. PATENT DOCUMENTS 3,761,953 9/1973 Helgeson et al. ..... 347/7
4,422,085 12/1983 Sumitomo et al. ..... 347/7
4,714,931 12/1987 Erskine et al. ..... 347/7
4,825,228 4/1989 Gloeckler et al. ..... 347/7
4,827,278 5/1989 Lecheheb ..... 347/7
4,862,192 7/1989 Slomianny ..... 347/7

FOREIGN PATENT DOCUMENTS 85-01696 4/1985 WIPO .

OTHER PUBLICATIONS

Patent Abstracts of Japan, vol. 5, No. 155 (M-90) (827), Sep. 30, 1981 & JP, A, 5682263 (Oki Denki Kogyo K.K.) Jul. 4, 1981.

*Primary Examiner*—A. T. Grimley
*Assistant Examiner*—Nestor R. Ramirez
*Attorney, Agent, or Firm*—Pollock, Vande Sande & Priddy

[57] ABSTRACT

An ink circuit particularly intended for pressurizing a pigment ink, for an ink jet printer, is disclosed. The main pressurization line (40) is connected to a first head (9) of a compressor (7), and the depressurization line (45) is connected to a second head (15) of the same compressor (7). Both pressurization and depressurization lines are totally independent from the ink circuits. Magnetic agitators means (3, 4) are provided at the base of the reservoirs (1 and 2) in order to avoid pigment settling. The ink circuit applies to the marking of media or supports, requiring an opaque white ink.

14 Claims, 2 Drawing Sheets

INK CIRCUIT PARTICULARLY INTENDED TO PRESSURIZE A PIGMENT INK FOR AN INK JET PRINTER

FIELD OF THE INVENTION

The invention refers to an ink circuit particularly intended to pressurize a pigment ink for an ink jet printer.

BACKGROUND OF THE INVENTION

In marking techniques, for certain applications such as when supports are dark-colored, it is necessary to use inks with large amounts of pigments, such as titanium oxide particles, which make the ink opaque and white.

Using such an ink in standard machines causes several problems. We know that in an ink jet printing device using a continuous jet of ink drops, the drops must be led pressurized to an assembly called the modulation body, with a projection nozzle at its tip. Also, the ink drops not used for printing must be gathered and returned to the recovery reservoir to circulate again in the printing device. Printing quality of a printer of this type is closely related to the speed of ejection of the ink through the nozzle. This speed can be altered by varying the pressure upstream from the opening, as well as by a change in ink viscosity, which may be due to a loss by evaporation of the ink solvent which is often volatile.

As regards ink pressurization devices and those for recovering unused ink drops, it is common to see pumps implemented in a first type of machine. This is true of the ink circuit described in French patent no. 2,353,441 registered by the Applicant. In application with inks that are heavy in pigments, the disadvantage is that these pigments quickly alter the pumps, reducing their reliability. Moreover, pumps create cyclic variations in pressure that can harm printing quality.

There are devices that use pressurized gas reservoirs. This technique requires the use of buffer reservoirs to recover the ink drops in the transfer phase from recovery reservoir to main reservoir. An example of this is the ink circuit described in French patent no. 2,405,819. Having several of these reservoirs does not easily lend itself to circulating a pigment ink, since the pigment tends to be deposited by gravity at the bottom of the reservoirs. Finally, implementing pressurized gas reservoirs, usually of compressed air, also requires a second energy source for the machines using them.

BRIEF DESCRIPTION OF THE INVENTION

In addition to these problems there is, as was stated previously, that of ink viscosity. To solve this, the Applicant perfected a viscosimeter described in the above-mentioned French patent no. 2.353.441. The process used was to measure the time it takes to fill one reservoir from another by draining, under the force of gravity, the ink through a calibrated opening.

The goal of the invention is to mitigate the consequences of pumps or reservoirs of compressed air of the known type, while authorizing the implementation of the viscosity measuring procedure described in French patent no. 2.353.441. It involves a general ink circuit comprising a first pressurization circuit and a second depressurization circuit independent of the first, operating from means that never actually touch the ink. In this circuit, means of shaking the ink make it possible to prevent any risk of pigments settling where they can be most expected to.

More precisely the invention refers to an ink circuit for a continuous ink jet printing device particularly suited to the use of an ink loaded with pigments to turn it opaque and white. This circuit comprises, on the one hand, means to pressurize a reservoir (6) for feeding ink to the printing head and, on the other hand, means to depressurize a reservoir (2) for recovering ink drops not used during the marking operation; a viscosimeter (27) equipped with means (28) to measure viscosity; ink (1) and solvent (20) reserve reservoirs connected to the recovery reservoir (2) to provide additional ink or solvent as a function of variations in ink viscosity; the circuit is characterized in that this viscosimeter (27) is connected, on the one hand, by two ink circuits, one (45) to the accumulating reservoir (6) via electrovalve (23), the other (44) to the bottom of the recovery reservoir (2) via electrovalve (21) and, on the other hand, by two air circuits, one (40) for pressurization via a bypass circuit (43) and an electrovalve (25), the other (46) via an electrovalve (22) making it possible to balance the pressure between the recovery reservoir (2) and the viscosimeter (27), with the latter carrying out the dual function of measuring viscosity and serving as ink transfer reservoir.

The invention is easier to understand with the explanations below and the attached illustrations including:

BRIEF DESCRIPTION OF THE INVENTION

For greater clarity any given elements are denoted by the same references in all illustrations.

DETAILED DESCRIPTION OF THE INVENTION

As was stated above, the invention refers to a pigment ink circuit suited to feeding an ink jet printing head in such a way that all disadvantages related to the presence of these pigments in the ink are avoided. The structure of this circuit and the combination of means used allows us to achieve, for this particular application, the three basic functions required for proper operation of an ink jet printer, i.e.:

- pressurization of the ink to ensure the flow of the ink jet;
- recovery of drops not used in printing;
- maintaining the high quality of the ink at optimal viscosity and maintaining the ink level in the accumulator.

In addition to these functions there is a fourth one in the circuit according to the invention, namely the permanent shaking of the ink in order to prevent pigment settling at the bottom of the reservoirs.

Figure 1:
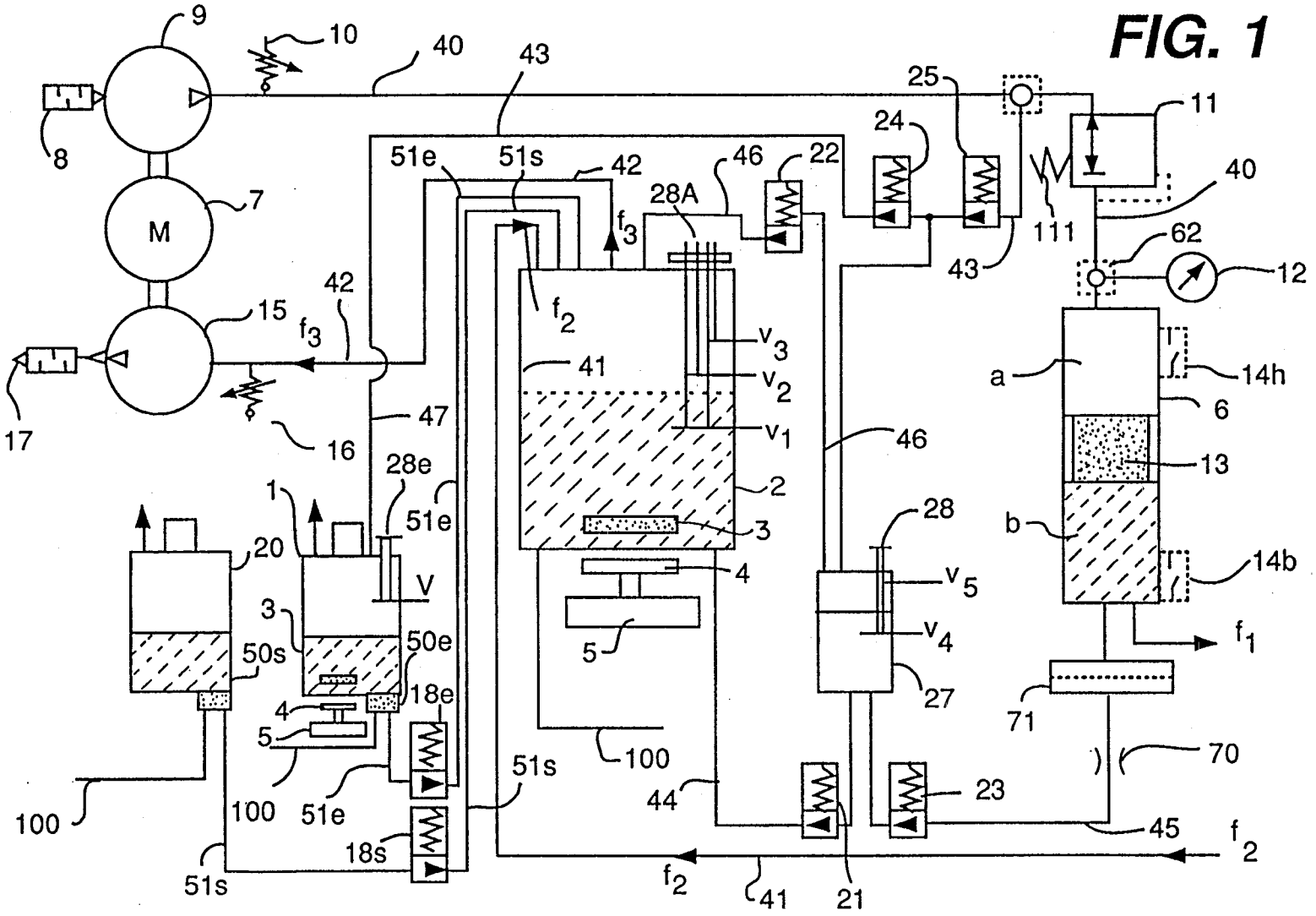
FIG. 1 is a general diagram showing the combination of means used in the ink feed circuit in conformity with the invention.

As FIG. 1 shows, pressurization of the ink to provide the jet is carried out by means of an ink accumulating reservoir (6) that is pressurized. The compressed air is generated through a first pressurization circuit by a first head (9) of a compressor (7). The air goes through a first filter (8) with a silencer, then goes through a second filter made of filtering foams, located inside the first head (9) also known as pressure head. In one of a number of possible constructions the air flow of this head is 1.6 $m^3$/hr. at atmospheric pressure. At the exit of the pressure head (9) a valve (10) calibrated at a threshold value of 4.2 bars, for example, limits the maximum operating pressure in the circuit. The air flowing through the lines (40) then goes into a control unit (11) that can precisely adjust the pressure before pressurizing the ink accumulating reservoir (6) which feeds the printing head. The printing head is not shown since it is of the known type.

An arrow ($f_1$) shows the exit of the ink from the accumulator (6) to the umbilical and its printing head.

The reference value for control unit (11) pressure is set by means of adjustment (111), which may be a combination of a screw and a flywheel, for example. This pressure is controlled with a manometer (12) mounted through a three-way connector (62) on the pressurization line (40).

The pressurized air enters the accumulating reservoir (6) by its upper part. The reservoir is composed of a cylinder in which a float (13) with two functions is sliding:

firstly; to achieve separation of the pressurized air (a) from the ink (b) in order to reduce the migration of air in the ink;

secondly; to make it possible to detect the levels in the accumulating reservoir (6) using two proximity detectors: (14*h*) for the high level and (14*b*) for the low level.

The accumulating reservoir (6) must have a sufficient volume for the quantity of ink it contains to allow the necessary cooling of the ink contained in the tubes of the umbilical and in the printing head.

While the latter is operating, unused drops are recovered in a drain, which is not shown since it is a part of the printing head which is already known, as we stated above. These recovered drops are returned to a recovery reservoir (2), as the arrow ($f_2$) shows, arranged on the recovery pipe (41). To achieve this result, the recovery reservoir (2) is depressurized by a second depressurization circuit composed of a second head (15) of the compressor (7) operating as vacuum pump. This depressurization head (15) is identical to the pressure head (9) and its flow/pressure characteristics are the same. On the pipe (42) there is a safety valve (16) calibrated to the tolerable limit value for depressurization in the recovery reservoir (2), and at the exit of the head (15) there is a filter with a silencer (17). Depressurization is represented by an arrow ($f_3$).

It is thus worth noting that the means of pressurization and depressurization composed of the first circuit comprising the general pipes (40) and the second circuit comprising pipes (42), respectively, are distinct from one another and connected to two heads (9) and (15) of a single compressor (7) which provides the pressurization of the accumulating reservoir (6) for feeding the printing head and puts the recovery reservoir (2) in partial vacuum. Moreover, these two lines (40) and (42) are completely independent of the pipes in which the ink circulates.

After having described the combination of a pressurization circuit (40) and a depressurization circuit (42) hooked up to two heads (9, 15) of a single compressor (7) in conformity with the invention, as well as the recovery circuit (41) of the ink, we will now describe the means used to maintain ink quality and the high level in the accumulating reservoir (6).

The ink is indeed highly volatile and its viscosity must be constantly checked and corrected by adding either ink or solvent. To do this, a solvent reservoir (20) and an ink reservoir (1) are provided, linked together via a filter (50*s*) and (50*e*), and linked through an electrovalve (18*e*) and (18*s*) to the upper part of the recovery reservoir (2) by pipes (51*s*) and (51*e*). The solvent reservoir (20) and the ink reservoir (1) are at atmospheric pressure. The ink reservoir (1) is connected to the compressed air line (40) (pressurization circuit) through two electrovalves (24) and (25). It is also connected to the transfer reservoir of the viscosimeter (27) by pipe (47) via electrovalve (24). This viscosity is measured by a viscosimeter (27) which is of the type described in French patent No. 2.353.441 registered by the Applicant. This is a reservoir in which the ink travels from the recovery reservoir (2) before being sent into the accumulating reservoir (6). This viscosimeter (27) is connected by a pipe (44), via an electrovalve (21), to the base of the described recovery reservoir (6). Pressure in the viscosimeter (27) depends on pressure in both pipes (46) and (43) connected via an electrovalve (22) to the top of the recovery reservoir (2) and to pipe (43) between the two valves (24) and (25), respectively.

The ink reservoir (1), the recovery reservoir (2), and the viscosimeter (27) are equipped with level detection means (28*e*), (28*a*), (28). These are electrodes that dip into the reservoir at heights corresponding to the minimum ink level (V) for the ink reservoir; to three levels, low ($V_1$), medium ($V_2$), and high ($V_3$), for the recovery reservoir; and lastly, to two levels ($V_4$) and ($V_3$), for the viscosimeter. The difference in height between ($V_4$) and ($V_5$) reconstitutes one of the parameters in measuring viscosity, as we will now explain.

The level measuring means (28) attached to the viscosimeter (27) are comprised of three dipping electrodes of which two are at the same low level ($V_4$) and the third is a level ($V_5$) above ($V_4$).

The level measuring means (28*e*) attached to the ink reservoir (1) are comprised of two electrodes that determine the level (V).

The level measuring means (282) attached to the recovery reservoir (2) are comprised of four dipping electrodes that determine three levels ($V_1$), ($V_2$), ($V_3$).

Since electrovalves (21) and (22) are open, the pressure of the viscosimeter (27) counterbalances that of the recovery reservoir (2), and the ink flows to pipe (44) through a calibrated opening and goes into the viscosimeter (27). The time it takes the level to go from ($V_4$) to ($V_5$) is measured. If this time is greater than a reference value, the ink is too viscous and some solvent is added. If this period is shorter than or equal to the reference value, ink viscosity is low or just right and nothing is changed. The natural evaporation of the solvent will increase viscosity. Thus the means of detection (28), electrovalves (21) and (22), and electrovalve (18*s*) that enables solvent to be added, are-mutually dependent. When the latter valve is open, the solvent is sucked in by pipe (51*s*) to the depressurized recovery reservoir (2). The same applies if new ink has to be inserted into the recovery reservoir (2). Electrovalve (18*e*) is put in open position and the ink is sucked in through pipe (51*e*) into the depressurized recovery reservoir (2).

When the high level ($V_5$) of the viscosimeter (27) is detected, electrovalves (23) and (25) are open and electrovalves (21), (24), (22) are closed. The viscosimeter (27) is thus connected to the compressed air by pipe (43). Pressurized, the ink contained in the viscosimeter is pushed to the accumulating reservoir (6) through electrovalve (23), an orifice (70) and a filter (71). The volume of air corresponding to the volume of ink entering the filter escapes by the pressure control unit (11). A buffer ink volume (a volume below the low level ($V_4$) of the viscosimeter) remains in the viscosimeter so as to guarantee that air will at no time be sent into the accumulating reservoir (6), in order to give electrovalves (23) and (25) enough time to close after detection of the low level of the viscosimeter (27).

After ink has been transferred from the viscosimeter (27) to the accumulating reservoir (6), a bubble of pressurized air is imprisoned in the viscosimeter (27). This bubble would be released roughly in the recovery reservoir (2) if electrovalves (21) and (22) were reopened, thus causing the depressurization level in the recovery reservoir (2) to drop immediately and in so doing, would disturb recovery of the unused drops coming from the drain. Thus, after a transfer, electrovalve (24) is open a few seconds, while the other electrovalves (21), (22), (23), (25) are closed to release the air bubble in the main new ink reservoir (1) which is at atmospheric pressure.

Electrovalve (24) is then closed and electrovalves (21), (22) are reopened for another filling of the viscosimeter (27).

The solvent reservoir (20), ink reservoir (1) and recovery reservoir (2) have a drainage opening (100). When the printer stops, all the ink contained in the accumulating reservoir (6) is returned to the recovery reservoir (2), so that the ink can be stirred up as will be explained later. For this, electrovalves (23) and (21) are open, and under the influence of the air pressure in the accumulating reservoir (6), the ink goes into the recovery reservoir (2). When the low level of the accumulating reservoir (2) is detected, electrovalve (23) is closed and electrovalve (25) opened to also empty the viscosimeter (27) into the recovery reservoir (2). Indeed, the air pressure thus applied in the viscosimeter pushes the ink to the depressurized recovery reservoir (2). When the low level of the viscosimeter (27) is detected, the compressor is stopped and electrovalves (24) and (25) are opened to release the air in the ink circuit so that the circuit does not remain pressurized. Then the printer stops. When the printer is started, since the compressor (7) cannot start under pressure, electrovalves (24) and (25) are opened for a few seconds to place the pressure head (9) of the compressor (7) under atmospheric pressure.

Figure 2:
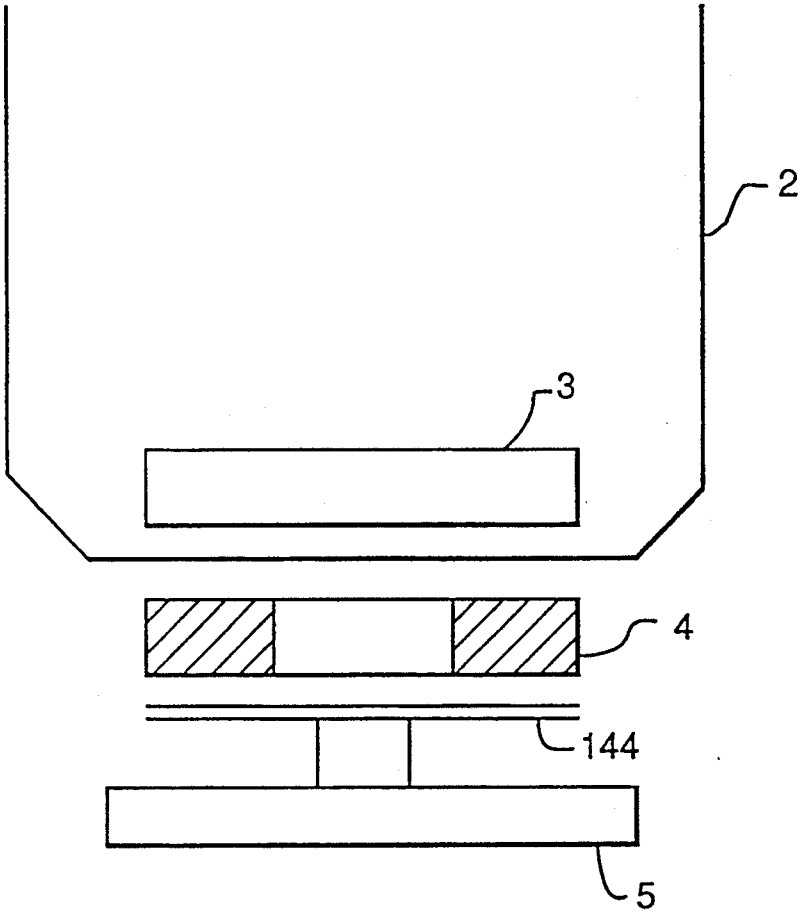
FIG. 2 is a diagram explaining one of the elements forming the circuit in FIG. 1.

According to another characteristic of the invention, there are means of constantly shaking the ink. Indeed, in order to keep it homogenous, regardless of how long it is used, the ink must be constantly mixed. The ink is stirred up in the main new ink reservoir (1) and in the recovery reservoir (2). The means are identical in both cases: a magnetic bar (3) covered with polytetrafluorethylene (PTFE) or with polypropylene, working with two magnets (4) (seen in FIG. 2) placed on a turning plate (144) turned by a step motor (5). The latter is fed as long as the printer remains connected to the power supply. Its turning speed is improved to guarantee homogeneity of the ink and low evaporation of the solvent. The advantage in a step motor is its sturdiness and its performances over long periods without maintenance, as well as its explosion-proof nature. The turning plate (144) is composed of a metal plate on which two constant magnets are attached as indicated in FIG. 2. A particular shape shown in this figure was chosen for the reservoirs. It is a truncated profile (P) that makes it possible to properly position the bar (3) over the turning plate (144).

If the printer remains disconnected from the power supply for several days, ink will inevitably settle at the bottom of the reservoir and, when the machine is hooked up, the turning speed of the motors (5) is greatly reduced to prevent the magnetic disconnection of the bar/turning plate assembly.

When the printer is in ready mode, all the ink of the circuit is stored in reservoirs (1) and (2) exclusively.

I claim:

1. Ink circuit for a printing device with a continuous ink jet, particularly adapted to the use of an ink charged with pigments so that it becomes opaque and white, comprising:

means for pressurization of ink contained in an accumulator reservoir, for supplying a printing head;

means for depressurization of the ink unused for the printing and recovered in a recovery reservoir;

a viscosimeter provided with means for measuring the ink viscosity;

an ink reservoir and a solvent reservoir connected to said recovery reservoir and used for the addition of ink and solvent according to variations of ink viscosity;

wherein said viscosimeter is connected to the bottom of said accumulator reservoir by a first ink duct and an electrovalve;

to the bottom of said recovery reservoir by a second ink duct and an electrovalve;

to a first air duct, connected to said means for pressurization by a derivation circuit and an electrovalve;

to the top of said recovery reservoir by a second air duct and an electrovalve;

said viscosimeter further serving as a transfer reservoir for the ink between said recovery reservoir and said accumulator reservoir.

2. Ink circuit according to claim 1, wherein said means for pressurization of the ink further comprises said accumulator reservoir connected to said first air duct to a first head of a single compressor, and said means for depressurization of the unused ink further comprises said recovery reservoir connected by a third air duct to a second head of said compressor, said first and third air ducts being totally independent of the ink ducts.

3. Ink circuit according to claim 1, wherein said first air duct for pressurization comprises a pressure regulator and means for measuring said pressure.

4. Ink circuit according to claim 1, wherein a top of said viscosimeter is connected to said ink reservoir by a fourth ink duct and an electrovalve, said viscosimeter serving as a transfer reservoir.

5. Ink circuit according to claim 1, further comprising:

a duct with an electrovalve between said ink reservoir and said recovery reservoir;

a duct between a recovery gutter and said recovery reservoir;

a duct with a calibrated flow and an electrovalve, between said recovery reservoir and said viscosimeter serving as a transfer reservoir; and a duct with an electrovalve between said viscosimeter and said accumulator.

6. Ink circuit according to claim 1, wherein said solvent reservoir is exposed to atmospheric pressure and is connected to the recovery reservoir by a duct for transfer of the ink.

7. Ink circuit according to claim 1, further comprising means for measuring the ink level in the ink reservoir, the accumulator and recovery reservoirs, and the viscosimeter.

8. Ink circuit according to claim 7, wherein said means for measuring the level, which are connected to said viscosimeter, are formed by three dip-coated electrodes, two of which are at the same low level and the third one at a level greater than the other two electrodes.

9. Ink circuit according to claim 7, wherein said means for measuring the level, connected to the ink reservoir, are formed by two electrodes.

10. Ink circuit according to claim 7, wherein said means for measuring the level, connected to said recovery reservoir, are formed by four dip-coated electrodes determining three distinct levels.

11. Ink circuit according to claim 7, wherein said means for measuring the level, connected to the accumulator reservoir, are formed by a float having the function of detecting the level by a proximity sensor, as well as performing the function of separating air from ink.

12. Ink circuit according to claim 1, wherein said ink and recovery reservoirs are equipped with means for agitating the ink inside said reservoirs.

13. Ink circuit according to claim 12, wherein said agitating means further comprises a bar magnet which cooperates with magnets placed on a turning platform driven in rotational movement by a stepper motor.

14. Ink circuit according to claim 13, wherein said recovery reservoir has a frusto-conical shape to ensure better centering of the bar magnet.

* * * * *